US010772474B2

(12) United States Patent
Ganger

(10) Patent No.: US 10,772,474 B2
(45) Date of Patent: Sep. 15, 2020

(54) COMMODE WIPES

(71) Applicant: David Ganger, Ft. Myers, FL (US)

(72) Inventor: David Ganger, Ft. Myers, FL (US)

( * ) Notice: Subject to any disclaimer, the term of this patent is extended or adjusted under 35 U.S.C. 154(b) by 113 days.

(21) Appl. No.: 16/251,353

(22) Filed: Jan. 18, 2019

(65) Prior Publication Data

US 2019/0328183 A1 Oct. 31, 2019

Related U.S. Application Data

(60) Provisional application No. 62/663,617, filed on Apr. 27, 2018.

(51) Int. Cl.

| | |
|---|---|
| ***A47K 7/02*** | (2006.01) |
| ***A47K 7/08*** | (2006.01) |
| ***A47L 13/18*** | (2006.01) |
| ***A47K 10/16*** | (2006.01) |
| *D21H 27/00* | (2006.01) |
| *B08B 1/00* | (2006.01) |

(52) U.S. Cl.

CPC ..... *A47K 7/08* (2013.01); *A47K 10/16* (2013.01); *A47L 13/18* (2013.01); *A47K 7/02* (2013.01); *B08B 1/006* (2013.01); *D21H 27/002* (2013.01)

(58) Field of Classification Search

CPC .... A47K 7/02; A47K 7/03; A47K 7/08; A47L 13/18

See application file for complete search history.

(56) References Cited

U.S. PATENT DOCUMENTS

| | | | | |
|---|---|---|---|---|
| 720,955 | A * | 2/1903 | Oberseider, Jr. ..... | A47L 13/18 |
| 1,345,026 | A | 6/1920 | Riley | |
| 3,211,145 | A | 10/1965 | Roy | |

(Continued)

FOREIGN PATENT DOCUMENTS

| | | | |
|---|---|---|---|
| DE | 102007052485 | A1 | 5/2009 |
| DE | 102015216787 | B3 | 12/2016 |

(Continued)

OTHER PUBLICATIONS

"Gloves Wipes—Multipacks" Germ Buddies, Dec. 20, 2016 http://www.germbuddies.com:80/products/glove-wipes.

(Continued)

*Primary Examiner* — Randall E Chin

(74) *Attorney, Agent, or Firm* — Robert C. Kain, Jr.

(57) ABSTRACT

The wipe includes an elongated, shallow v-shaped tissue wipe having proximal and distal ends and, at the terminal proximal end, laterally spaced apart left-side and right-side finger apertures. Upper and lower tissue layers form finger apertures. An angle controller limits the v-shape of the wipe. A plurality of elongated corrugated ribs are longitudinal support elements and the upper tissue layer of said left and right side finger apertures form respective left and right finger tents permitting lateral expansion of the wipe between the finger apertures. Another embodiment has at least two elongated corrugated ribs disposed intermediate the laterally spaced apart left-side and right-side finger tents thereby permitting lateral expansion of said wipe the finger tents. The v-shaped wipe forms a distal excrement collection surface on a distal leg of the wipe longitudinally spaced apart from a proximal leg. The proximal leg terminates at the entrance of the finger tents.

11 Claims, 5 Drawing Sheets

(56) References Cited

U.S. PATENT DOCUMENTS

| | | | | |
|---|---|---|---|---|
| 4,523,348 | A | 6/1985 | Petrie | |
| 4,987,632 | A | 1/1991 | Rowe et al. | |
| 5,127,127 | A | 7/1992 | Jarosinski | |
| 5,473,789 | A | 12/1995 | Oster | |
| 5,900,068 | A * | 5/1999 | Thomas | A45D 40/28 134/6 |
| 5,987,645 | A | 11/1999 | Teaster | |
| 6,146,365 | A | 11/2000 | Nguyen | |
| 7,033,342 | B2 | 4/2006 | Mizutani et al. | |
| D570,062 | S * | 5/2008 | Berryman | D32/40 |
| 7,484,261 | B2 | 2/2009 | Sigl et al. | |
| 7,665,176 | B2 | 2/2010 | Benjamin et al. | |
| 7,698,773 | B2 | 4/2010 | Soteio | |
| 7,725,979 | B1 | 6/2010 | Held et al. | |
| 8,156,598 | B2 | 4/2012 | Modowell | |
| 8,341,796 | B1 | 1/2013 | Rhee | |
| 9,723,958 | B1 * | 8/2017 | Walker | A47K 7/08 |
| 2001/0044983 | A1 | 11/2001 | Maaghul | |
| 2002/0026679 | A1 | 3/2002 | Widlund | |
| 2009/0159225 | A1 | 6/2009 | Geoffrey et al. | |
| 2009/0178222 | A1 | 7/2009 | Flemister et al. | |
| 2013/0260073 | A1 | 10/2013 | O'daniel | |
| 2015/0282540 | A1 * | 10/2015 | Zeng | A41D 19/0089 2/168 |
| 2015/0366415 | A1 | 12/2015 | Doolittle | |
| 2017/0325649 | A1 | 11/2017 | Reddy et al. | |

FOREIGN PATENT DOCUMENTS

| | | | |
|---|---|---|---|
| GB | 2350781 | A | 3/2000 |
| JP | 2004113601 | | 4/2004 |
| WO | WO 2014022607 | A2 | 2/2014 |
| WO | WO 2014116106 | A1 | 7/2014 |

OTHER PUBLICATIONS

"Home" Shittens, getshittens.com Dec. 15, 2013 https://www.getshittens.com.

FreedomWand Differences Between the Freedom Wand, Bottom Buddy, and Self Wipe, by Freedomwand Admin, Feb. 28, 2018.

* cited by examiner

Finger Aperture
Open

Finger Aperture Closed

COMMODE WIPES

This is a regular patent application based upon and claiming the benefit of provisional patent application Ser. No. 62/663,617 filed on Apr. 27, 2018, the contents of which is incorporated herein by reference thereto.

This invention is a commode wipe that assists a person in removing excrement from the person's buttocks during a personal hygiene event.

BACKGROUND OF THE INVENTION

There is a need for a completely disposable commode wipe that can be used by persons who cannot reach all or part of their anus, anal orifice and adjacent buttock regions with customary toilet tissue papers after a bowel movement. A wide variety of persons have such limited mobility issues. The present invention solves this problem with a completely disposable tissue-based structure that extends the reach of the person's hands with a shallow V-shaped commode wipe.

U.S. Pat. No. 5,127,127 to Jarosinski discloses a unitary hand-held wipe comprising a sheet of absorbent paper having a primary wiping layer defining a flat generally rectangular surface large enough to fully cover the fingers of a hand of average size said sheet including an extended length portion folded on a main fold line to form an overlying layer substantially covering the primary wiping layer and sealing means forming spaced seams binding the primary layer and the overlying layer said seams extending generally perpendicular to the main fold line and defining between said seams finger-receiving pockets. Jaronski '127 does show a shallow V-shaped commode wipe with finger pockets and an outboard extension platform extending beyond the user's hand and fingers. Jarosinski explains: "In FIGS. 6 and 7, there is shown yet another embodiment of the invention in which the wipe comprises a substantially full hand-covering mitt 43. The single unitary sheet 44 used to form the mitt 43 includes a primary wiping layer 44 and an extended length portion 45 similar to those shown in the FIG. 1 embodiment. The extended length portion 45 fans laterally outwardly to provide an increased lateral width piece which is folded on a main fold line 46 to provide an overlying layer 47 substantially covering the primary wiping layer 44. The overlying layer 47 is gathered and attached to the primary layer 44 with five spaced seams 48 lying generally perpendicular to the main fold line 46 and forming with the bound layers four finger pockets 50. The construction show in FIGS. 3 and 4 could also be used to form the pockets and eliminate the outer seams, as previously described." Jaronski '127 at Col. 4, lines 30-42.

U.S. Patent Application No. 2002/0026679 to Widlund discloses a cellulose wipe for cleaning the genital and anal region, having tunnel-shaped gripping members for insertion of at least one finger and at most three fingers into the tunnel-shaped gripping member. The Widlund '679 does not disclose a shallow V-shaped commode wipe wherein one leg of the V-shape is defined by the finger hole plate system and the other leg of the V-shape wipe extends outboard beyond the user's fingers.

Patent No. WO 2014022607A2 to Findlay et al. discloses a disposable cleaning paper such as paper towels or toilet paper in which the user inserts the hand or finger(s) into the sheet.

U.S. Pat. No. 7,698,773 to Sotelo discloses a holder for hygienic wipes and the like including a triangular-shaped base member that is suitably sized and shaped for securing a wiping sheet thereto and having a handle hingedly connected to the base member, enabling the user to angle the base member for optimal contact and comfort.

U.S. Patent Application No. 2009/0178222 to Flemister et al. discloses a personal flushable hygiene wipe comprising a fabric sheet 16 inches in length and having a fold along the length of the wipe which reduces its 6 inches in width to 3 inches in width, wherein the 3 inch width provides strength and wherein a hole at either end of the wipe pad attaches a 4 inch loop strap allowing hand or finger gripping which extends the reaching potential of its user.

U.S. Pat. No. 8,156,598 to McDowell discloses a cellulosic personal hygiene device comprising thumb holes and wherein the distal ends of the first and second end portions are folded back toward the center of the flexible strip and affixed to the respective end portions to form respective reinforced ends including being folded over the middle portion so as to completely conceal the first side after use but prior to disposal.

SUMMARY OF THE INVENTION

The commode wipe includes, in one embodiment, an elongated, shallow v-shaped wipe made of disposable tissue paper. The v-shaped wipe has a proximal end and a distal end. At the proximal end, left-side and right-side finger apertures are laterally spaced apart and are formed between respective upper and lower tissue layers. An angle control band limits the v-shape of the elongated, shallow v-shaped wipe. Additionally, a plurality of elongated corrugated ribs act as longitudinal support elements. The upper tissue layer of the left-side and right-side finger apertures form finger tents with a lower base tissue layer. These tents permit lateral expansion of the wipe. Further, the finger tents each have a pair of corrugated ribs further permitting lateral expansion. The wipe forms a distal excrement collection surface on a distal leg longitudinally spaced apart from a proximal leg of the wipe. The proximal leg terminates in the left-side and right-side finger tents. Usually, the angle control band is attached at one end to the distal leg and is attached at another end to the proximal leg such that the angle control band controls the angle between the distal leg and the proximal leg.

Another basic embodiment of the wipe includes an elongated, shallow v-shaped wipe made of disposable tissue paper with the wipe having a proximal end and a distal end. The wipe also has a tissue base sheet. At the proximal end, left and right side finger apertures are formed between respective upper tissue layers and the tissue base sheet. The finger apertures are laterally spaced apart. The upper tissue layer of the left-side finger aperture forming a left-side finger tent with an adjacent left segment of the tissue base sheet and the upper tissue layer of the right-side finger aperture forming a right-side finger tent with an adjacent right segment of the tissue base sheet. The left and right finger tents permit lateral expansion of the wipe. A plurality of elongated corrugated ribs act as longitudinal support elements within the wipe. Two elongated corrugated ribs are disposed intermediate the laterally spaced apart left-side finger tent and right-side finger tent thereby permitting the lateral expansion of the wipe between the left and right side finger tents.

Further, these finger tents are defined by respective pairs of elongated corrugated ribs which further permits lateral expansion of the wipe between the left-side finger tent and right-side finger tent. The v-shaped wipe forms a distal excrement collection surface on a distal leg of the wipe longitudinally spaced apart from a proximal leg of the wipe.

The proximal leg terminates in the left and right side finger tents. A lateral fold detent may demarcate the distal leg from the proximal leg. The left and right side finger tents do not longitudinally extend into the distal leg. An angle control band controls the angle between the distal leg and the proximal leg. The angle control band is attached to the proximal and the distal legs.

DETAILED DESCRIPTION OF THE PREFERRED EMBODIMENTS

This invention relates to a commode wipe that assists a person in removing excrement from the person's buttocks during a personal hygiene event.

Figure 1:
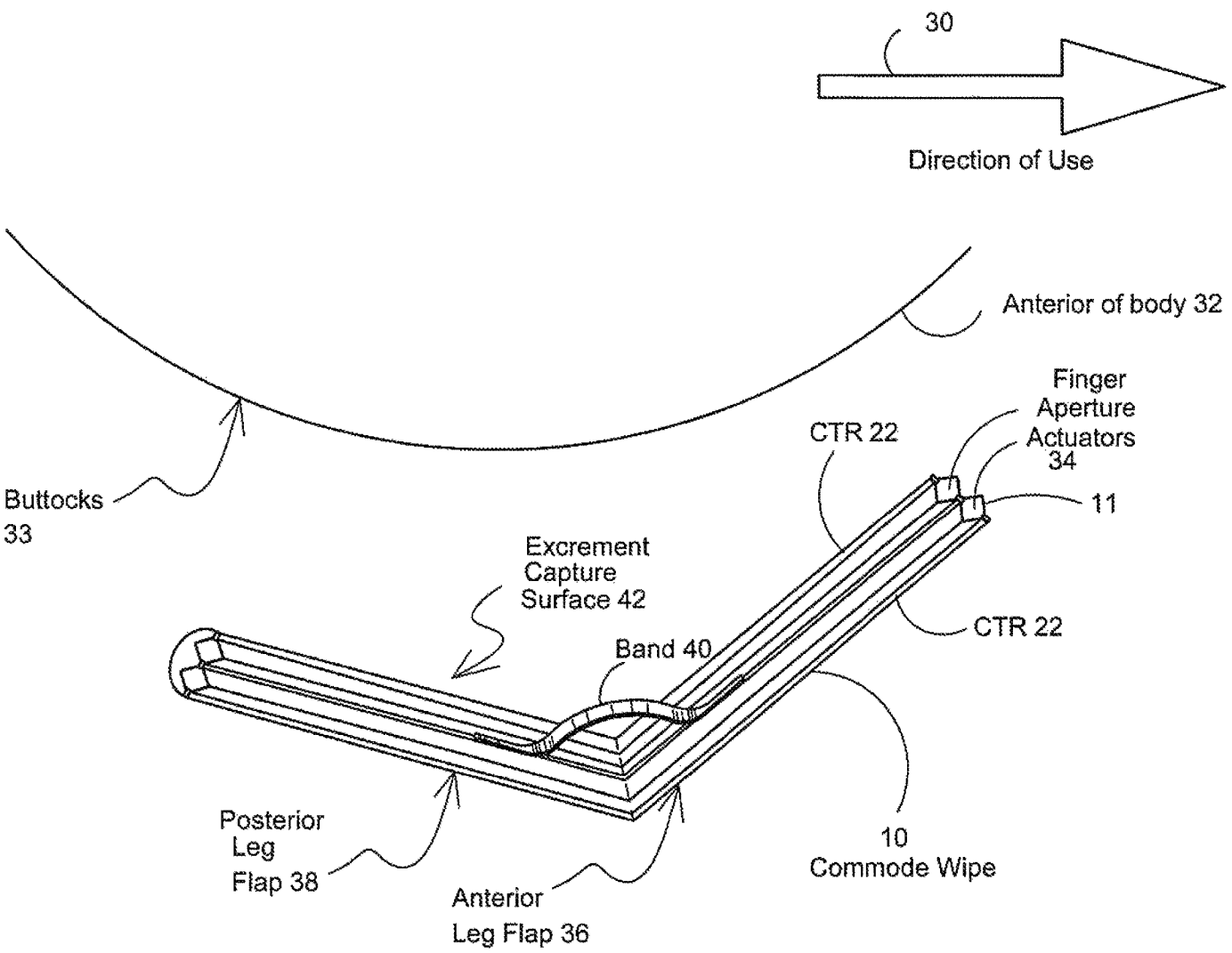
FIG. 1 shows the commode wipe in an operative, open manner or mode when fully extended to a shallow V-shape to remove excrement from the buttocks of a person.

FIG. 1 shows the elongated commode wipe 10 in an operative, open manner or mode when fully extended to a shallow V-shape to remove excrement from the buttocks 33 of a person. In general and operationally, the user opens the folded commode wipe (FIG. 3, closed), opens the corrugated tissue ridges 22 (FIG. 2, finger apertures open), inserts his or her fingers into apertures 34, and then opens the commode wipe into the V-shaped wipe shown in FIG. 1. The user's fingers are disposed in the finger apertures 34 at the right side of the V-shaped wipe and the user positions the outboard wing or posterior leg flap 38 of the commode wipe (the left side V-leg in FIG. 1) at or near the location of the excrement on the buttocks 33. The excrement is collected on the commode wipe 10 on excrement capture surface 42 atop the outboard V-leg 38 when surface 42 is moved over buttocks 33 in direction 30.

The commode wipe 10 is an angled, shallow V-shaped structure. Leg 38 being distally disposed away from the user's fingers in apertures 34. The fingers being proximally disposed in the wipe. The angular displacement of outboard posterior V-leg 38 is at an obtuse angle with respect to the inboard or proximal anterior V-leg 36 (atop the finger apertures 34). These flaps 36, 38 are disposed at an obtuse angle which angle is limited by an angle limiter band 40 extending between posterior flap 38 and anterior flap 36. Alternatively, a smaller angle (normal or acute) may be used, dependent upon field test results.

As discussed later, the user places his or her fingers in finger aperture actuators 34 at the terminal end 11 of the anterior or inboard V-leg flap 36 and opens the commode wipe to open up and provide tissue ridges, herein called "corrugated ridges". The term "corrugated ridges" is used as short-hand because the ridges form a "corrugated-like" wipe structure. With fingers inserted into the apertures 34, corrugated tissue ridges CTRs 22 are formed on the upper operative surfaces of the wipe. See FIGS. 2 and 3.

Figure 2:
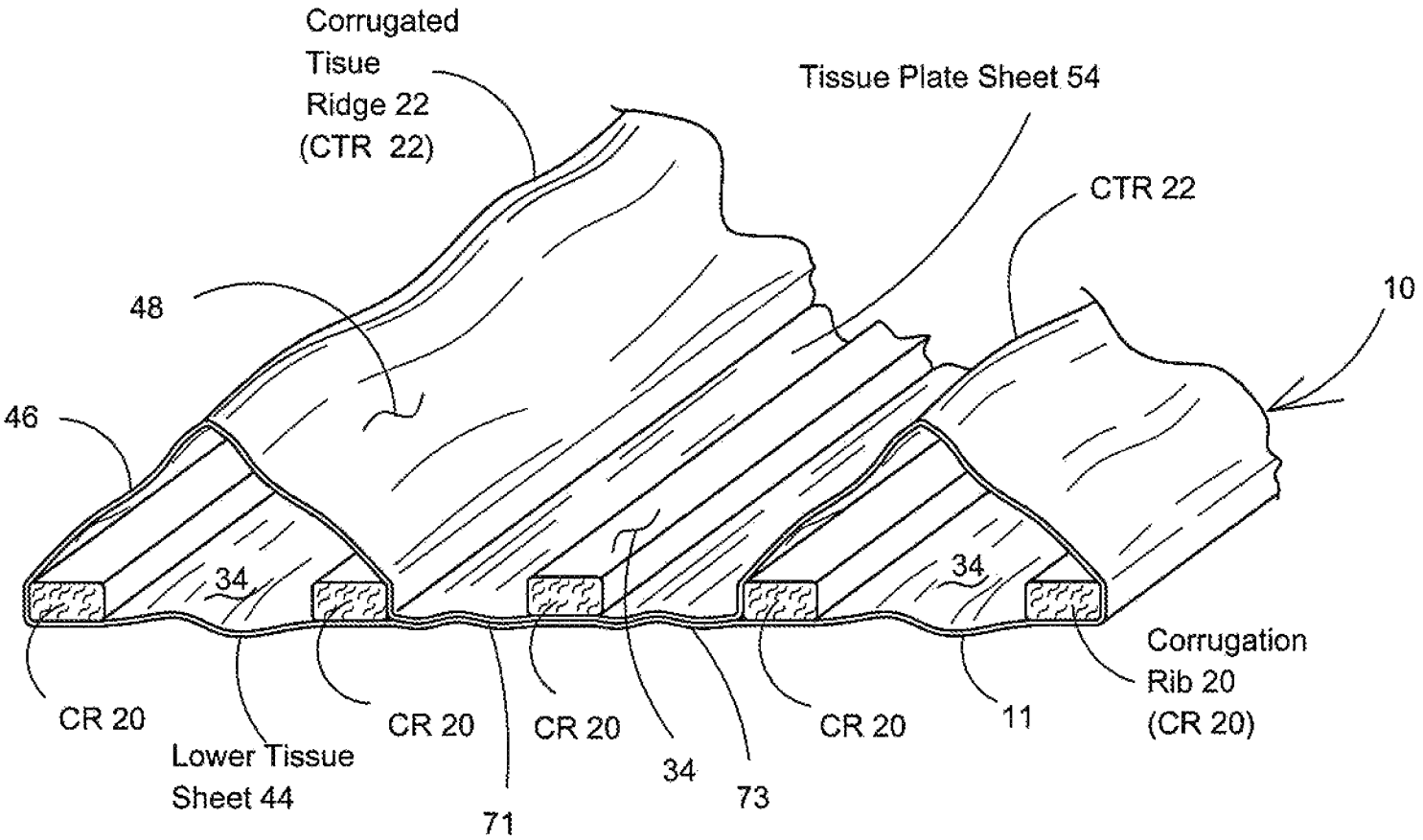
FIG. 2 shows finger apertures in an open state, formed between the corrugated tissue ridges (CTRs) and corrugation ribs (CRs).

FIG. 2 shows finger apertures 34 in an open state. These finger apertures 34 are formed between the corrugated tissue ridges 22 (CTRs 22) and corrugation ribs 20 (CRs 20). To open the CTRs, the user inserts his or her fingers into the rib apertures 34. The plurality of elongated corrugated ribs CRs 20 are longitudinal support elements for the wipe 10. In the illustrated embodiment, there are five ribs CRs 20; one central rib and two ribs on either side of the central rib. The central rib may be omitted or may be a double tissue layer. The proximal terminal end 11 of each respective outer pair of ribs CRs 20 (the CR pair on the left-side of the wipe compared to the laterally disposed pair of CRs on the right-side of the wipe) form the finger apertures 34 with the attached tissue sheets 46, 48 when the user places his or her finger into the finger apertures 34. When open, tissue sheets 46, 48 open and form triangular shaped apertures 34 above the base tissue plate sheet 54. At the proximal end where the fingers are inserted, a left-side finger aperture and a right-side finger aperture are laterally spaced apart and are formed between respective upper tissue layers and respective lower tissue layers. Attached tissue sheets 46, 48 (see left-side CTR 22) are upper tissue layers forming a tissue tent aperture above base tissue layer or tissue plate sheet 54. The tissue finger tents may form a triangular shape for the fingers.

Figure 3:
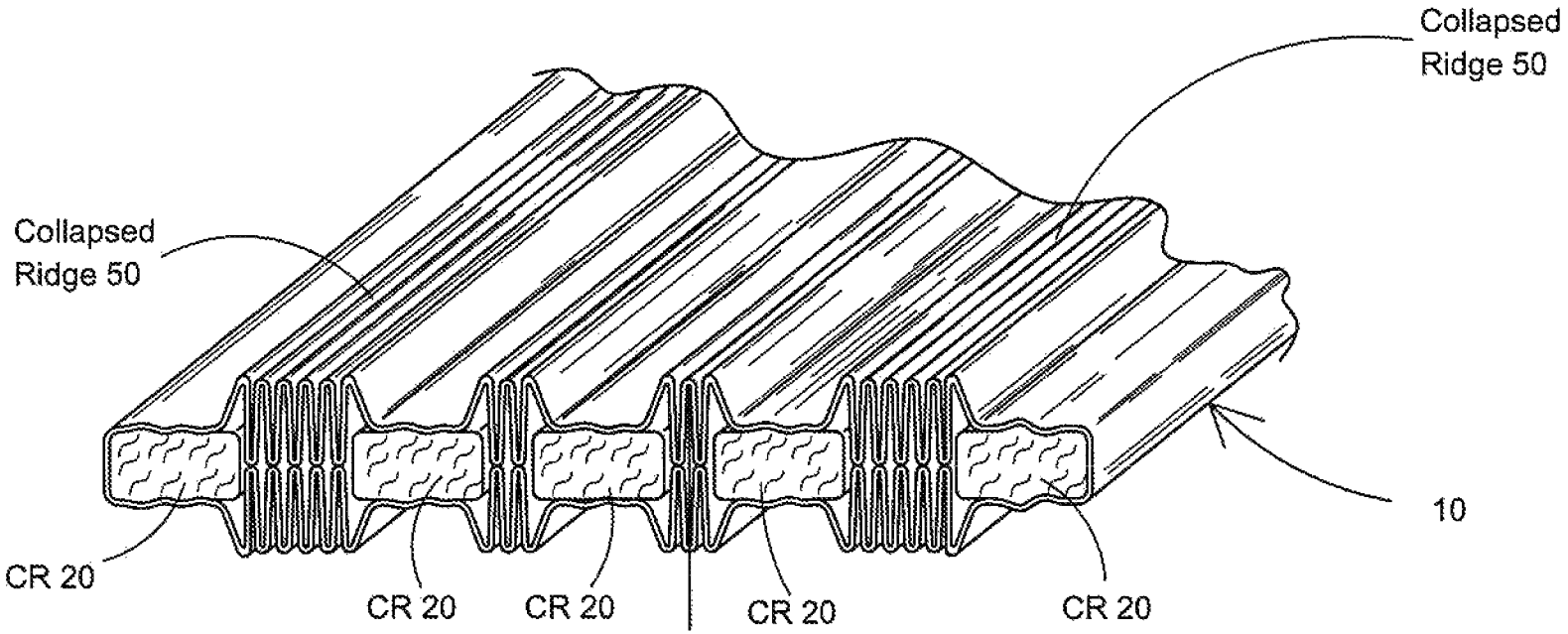
FIG. 3 diagrammatically shows the commode wipe in a collapsed state wherein tissue ridges CTRs are collapsed and corrugation ribs CRs are disposed somewhat adjacent each other.

FIG. 3 diagrammatically shows the commode wipe in a collapsed state. In the collapsed state, the tissue ridges CTRs 22 are collapsed and corrugation ribs CRs 20 are disposed somewhat adjacent each other. When fingers are inserted into the apertures 34, the ridges CTRs 22 open up when the user laterally moves ribs CRs 20 apart.

Returning to FIG. 2, and with respect to portions of the tissue plate sheet 54 on the left and right side of the central corrugation rib CR 20, those laterally extending tissue plate sheets 71, 73 assist in the collection of excrement on the excrement capture surface.

It should be noted that two finger apertures 34 are needed for the inventive commode wipe but there may be many more than two apertures 34 and more than five (5) corrugation ribs 20. Also, there may be as few as two (2) corrugation ribs 20, each rib defining a portion of the laterally spaced apart finger apertures 34.

Figure 4:
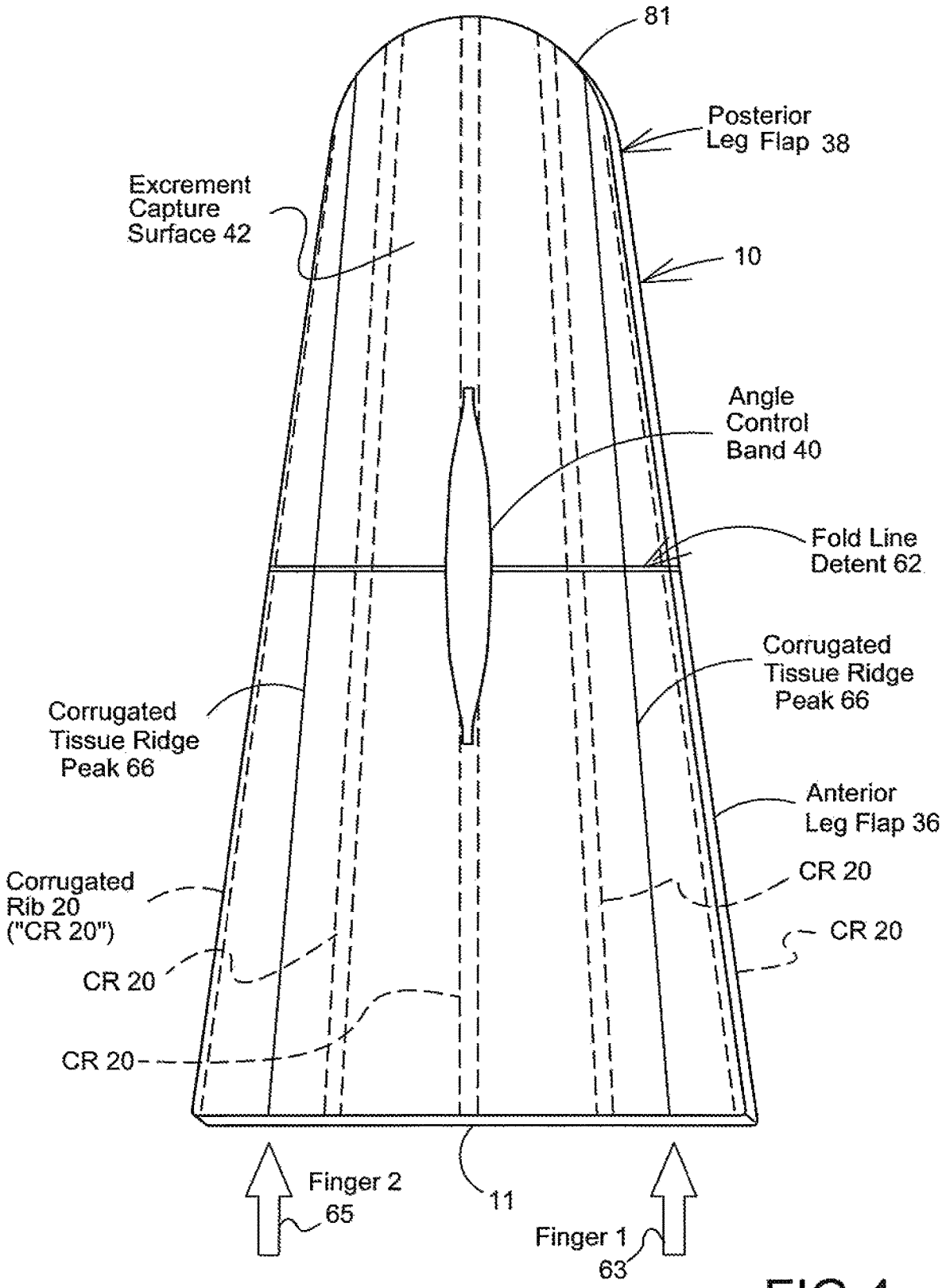
FIG. 4 diagrammatically illustrates a top plan view of the commode wipe in a closed or collapsed shape wherein the collection side of the commode wipe is generally conical with a smooth curve at the posterior terminal end and a squared off terminal end at the anterior terminal end.

FIG. 4 diagrammatically illustrates a top view of the commode wipe in a closed or collapsed shape. The overall shape or plan view of the collection side of the commode wipe 10 is generally conical with a smooth curve at the terminal end 81 of the posterior (outboard) V-leg flap 38 and a squared off terminal end 11 at the anterior (inboard) V-leg flap 36. The commode wipe has a fold line detent 62 generally midway between the angle control band 40. The fold line 62 generally defines the posterior V-leg flap 38 from the anterior V-leg flap 36. In a complete compact shape, the operative collection surface of the posterior V-leg flap 38 is folded such that it is adjacent the operative collection surface of anterior V-leg flap 36. Corrugation ribs CRs 20 are shown in the figure as is the insertion points for the user, that is, arrows 63, 65 for finger 1 and finger 2.

Figure 5:
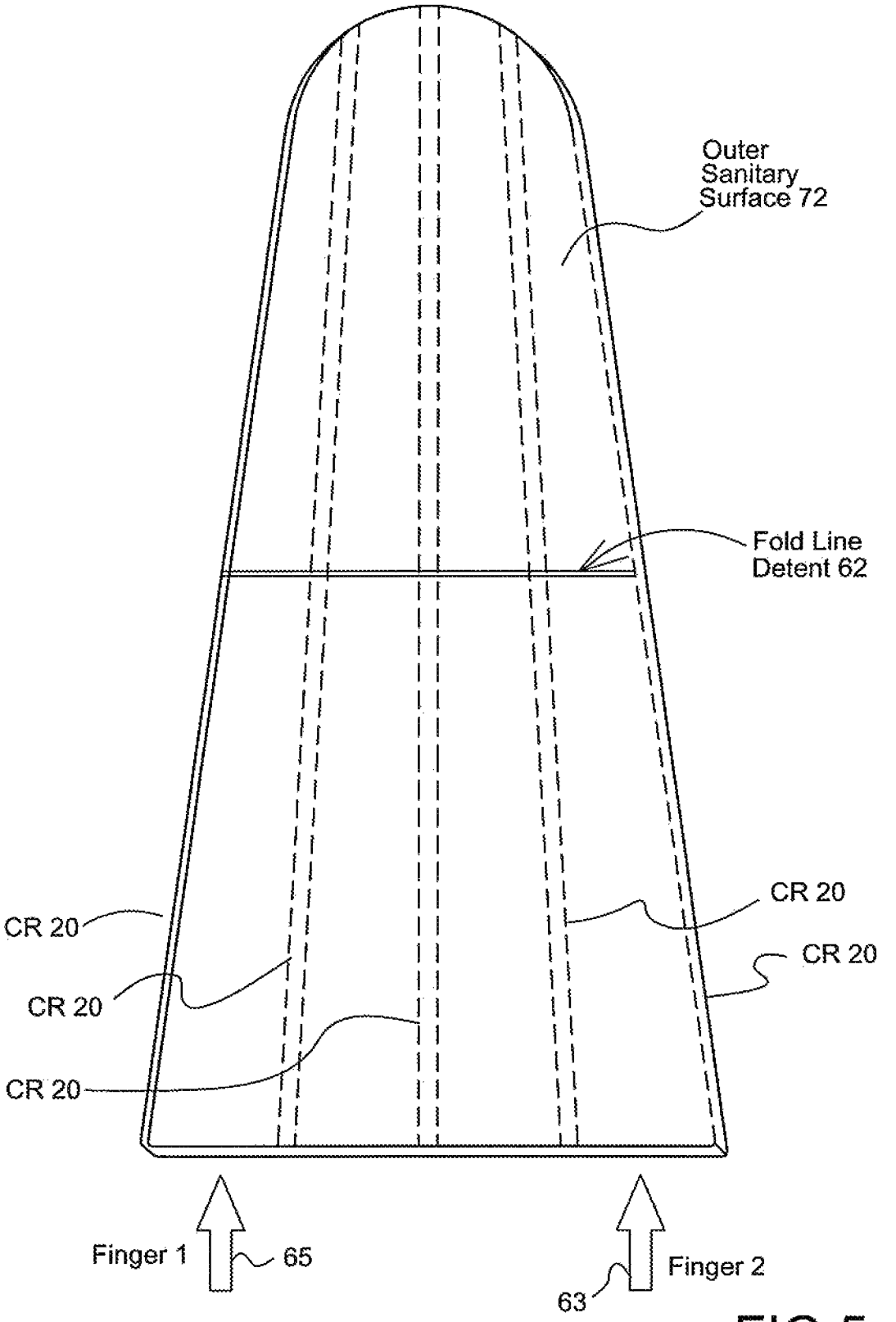
FIG. 5 shows the outer or anti-collection plan view showing the sanitary surface of the commode wipe and corrugation ribs CRs. 20.

FIG. 5 shows the outer or anti-collection, sanitary surface 72 (opposite collection surface or excrement capture surface 42 in FIG. 1) of the commode wipe 10 and corrugation ribs CRs 20. FIG. 5 is a plan view.

In use, the commode wipe 10 is initially in a completely collapsed state wherein the posterior V-leg flap 38 is folded such that it is adjacent the anterior V-leg flap 36. The user's interaction and the operation of the wipe is discussed above. The wipe 10 has an indeterminate length (see FIGS. 4-5) that is generally based upon the user's needs (a larger person would use a longer commode wipe). The commode wipe 10 may be folded onto itself along fold line 62 thereby collapsing the anterior V-leg flap 36 onto the posterior V-leg flap 38. Of course, in the collapsed state, the corrugated tissue ridges CTRs 22 are generally laterally collapsed next to each other as shown in FIG. 3. Also, the left and right tissue plate sheets 71, 73 are collapsed onto each other about the central corrugation rib CR 20. In this collapsed state, the central CR 20 is laterally next to both the near left and the near right ribs CRs 20. The result, in this collapsed shape, is a structure at least 6 tissue sheets thick (each CTR being 2 tissue sheets thick, see ridge-forming sheets 46, 48 on the left side of FIG. 2).

When the user wants to deploy the commode wipe, the user pulls the commode wipe laterally open (opening left-side CR 10 from the right-side CR 20 and opening the wipe laterally away from the central CR 20), thereby opening both the corrugated tissue ridges 22 (see open sheets 46, 48) and partly opening the finger insertion actuator apertures 34 (the apertures initially generally flat in the pre-expanded, intermediate positional state). Then, the user inserts his or her fingers between the lower tissue plate sheet 54 and the tissue sheets or plates 46, 48 loosely separated by the laterally moving apart left-side corrugated tissue ridge CTR 22 and right side CTR 22. This is the CTR operational positional state or mode. By inserting the user's fingers into the finger aperture actuator 34, the user pops open the wipe and pops up the corrugated tissue ridges CTRs 22 (see FIG. 2) and also unfolds the posterior leg flap 38 from the anterior leg flap 36. Alternatively, the user may unfold the anterior flap 36 from the posterior flap 38 before opening the finger apertures 34. The unfolded state is an unfolded operational positional mode shown in FIG. 1.

Once the CTRs 22 are formed and the wipe is unfolded at the controlled angle (see FIG. 1, and the control angle band 40), the user then positions the commode wipe in a way such that excrement is collected on the capture surface 42 of the posterior V-leg flap 38. After collection, the user can fold up the wipe 10 and cover capture surface 42 with anterior flap 36. The user can then either dispose of the entire commode wipe into the commode or collapse it further as needed.

Importantly, the entire commode wipe is made of cellulose and is entirely biodegradable and disposable down typical toilet systems. Effectively, it is nothing more than common tissue with some limited structural elements.

The claims appended hereto are meant to cover modifications and changes with the scope and spirit of the present invention.

The invention claimed is:

1. A commode wipe comprising:

an elongated, shallow v-shaped wipe made of disposable tissue paper;

said v-shaped wipe having a proximal end and a distal end;

at said proximal end, a left-side finger aperture and a right-side finger aperture which apertures are laterally spaced apart and are formed between respective upper tissue layers and respective lower tissue layers; and an angle control band limiting said v-shape of said elongated, shallow v-shaped wipe.

2. The commode wipe as claimed in claim 1 wherein said wipe includes:

a plurality of elongated corrugated ribs as longitudinal support elements; and said upper tissue layer of said left-side finger aperture forming a left-side finger tent and said upper tissue layer of said right-side finger aperture forming a right-side finger tent, wherein said left-side finger tent is laterally spaced apart from said right-side finger tent to permit lateral expansion of the wipe.

3. The commode wipe as claimed in claim 2 wherein said left-side finger tent is disposed between a pair of left-side corrugated ribs and said right-side finger tent is disposed between a pair of left-side corrugated ribs.

4. The commode wipe as claimed in claim 3 wherein said v-shaped wipe forms a distal excrement collection surface on a distal leg of said v-shaped wipe longitudinally spaced apart from a proximal leg of said v-shaped wipe which proximal leg terminates in said left-side finger tent and said right-side finger tent.

5. The commode wipe as claimed in claim 4 wherein said angle control band is attached at one end to said distal leg and is attached at another end to said proximal leg such that said angle control band controls the angle between said distal leg and said proximal leg.

6. The commode wipe as claimed in claim 5 wherein said left-side and right-side finger tents do not longitudinally extend into said distal leg.

7. A commode wipe comprising:

an elongated, shallow v-shaped wipe made of disposable tissue paper;

said v-shaped wipe having a proximal end and a distal end;

said v-shaped wipe having a tissue base sheet;

at said proximal end, a left-side finger aperture and a right-side finger aperture which apertures are laterally spaced apart and are formed between respective upper tissue layers and said tissue base sheet;

said upper tissue layer of said left-side finger aperture forming a left-side finger tent with an adjacent left segment of said tissue base sheet and said upper tissue layer of said right-side finger aperture forming a right-side finger tent with an adjacent right segment of said tissue base sheet, wherein said left-side finger tent is laterally spaced apart from said right-side finger tent to permit lateral expansion of the wipe; and a plurality of elongated corrugated ribs as longitudinal support elements within said wipe, at least two elongated corrugated ribs disposed intermediate said laterally spaced apart left-side finger tent and right-side finger tent thereby permitting said lateral expansion of said wipe between said left-side finger tent and right-side finger tent.

8. The commode wipe as claimed in claim 7 wherein said left-side finger tent includes a left-side pair of laterally spaced apart elongated corrugated ribs and right-side finger tent includes a right-side pair of laterally spaced apart elongated corrugated ribs, said left-side pair of ribs and said right-side pair of ribs thereby permitting said lateral expansion of said wipe between said left-side finger tent and right-side finger tent.

9. The commode wipe as claimed in claim 8 wherein said v-shaped wipe forms a distal excrement collection surface on a distal leg of said v-shaped wipe longitudinally spaced apart from a proximal leg of said v-shaped wipe which proximal leg terminates in said left-side finger tent and said right-side finger tent.

10. The commode wipe as claimed in claim 9 wherein a lateral fold detent demarcates said distal leg from said proximal leg and wherein said left-side and right-side finger tents do not longitudinally extend into said distal leg.

11. The commode wipe as claimed in claim 10 including an angle control band controlling the angle between said distal leg and said proximal leg.

* * * * *